US009964106B2

(12) United States Patent
Hembree

(10) Patent No.: US 9,964,106 B2
(45) Date of Patent: May 8, 2018

(54) DIAPHRAGM PUMP WITH DUAL SPRING OVERFILL LIMITER

(71) Applicant: Wanner Engineering, Inc., Minneapolis, MN (US)

(72) Inventor: Richard D Hembree, Port Coquitlam (CA)

(73) Assignee: Wanner Engineering, Inc., Minneapolis, MN (US)

( * ) Notice: Subject to any disclaimer, the term of this patent is extended or adjusted under 35 U.S.C. 154(b) by 174 days.

(21) Appl. No.: 14/931,614

(22) Filed: Nov. 3, 2015

(65) Prior Publication Data

US 2016/0123319 A1 May 5, 2016

Related U.S. Application Data

(60) Provisional application No. 62/075,070, filed on Nov. 4, 2014.

(51) Int. Cl.
*F04B 43/00* (2006.01)
*F04B 49/10* (2006.01)
(Continued)

(52) U.S. Cl.
CPC ..... *F04B 49/106* (2013.01); *F04B 9/107* (2013.01); *F04B 23/02* (2013.01);
(Continued)

(58) Field of Classification Search
CPC .. F04B 43/0081; F04B 43/073; F04B 43/067; F04B 43/06; F04B 9/107
(Continued)

(56) References Cited

U.S. PATENT DOCUMENTS 1,976,151 A 10/1934 Thaheld
3,416,461 A 12/1968 McFarland
(Continued)

FOREIGN PATENT DOCUMENTS

WO 2004/106884 A1 12/2004
WO 2004106884 12/2004

OTHER PUBLICATIONS

International Search Report and Written Opinion for PCT/US2015/059027, dated Jan. 20, 2016.
(Continued)

*Primary Examiner* — Charles Freay
*Assistant Examiner* — Christopher Bobish
(74) *Attorney, Agent, or Firm* — Merchant & Gould P.C.

(57) ABSTRACT

A diaphragm pump includes a housing having a pumping chamber containing fluid. The pump has a transfer chamber containing hydraulic fluid, and a hydraulic fluid reservoir in fluid communication with the transfer chamber. The pump housing forms a cylinder with a piston defining a piston inner chamber and sliding in the cylinder. A valve leads to the piston inner chamber with a valve spool slidably mounted in the piston inner chamber to cover the valve and uncover the valve. A diaphragm connects to the valve spool by a plunger. An overfill limiter includes a spacer slidably mounted in the piston inner chamber. A first spring is intermediate the valve spool and the spacer and a second spring is intermediate the end of the piston inner chamber and the spacer, the second spring having a second spring constant greater than the spring constant of the first spring.

9 Claims, 5 Drawing Sheets

(51) Int. Cl.

| | |
|---|---|
| ***F04B 43/067*** | (2006.01) |
| ***F04B 23/02*** | (2006.01) |
| ***F04B 43/073*** | (2006.01) |
| ***F04B 53/10*** | (2006.01) |
| ***F04B 53/14*** | (2006.01) |
| ***F04B 53/16*** | (2006.01) |
| ***F04B 9/107*** | (2006.01) |
| ***F04B 53/06*** | (2006.01) |

(52) U.S. Cl.
CPC ..... *F04B 43/0081* (2013.01); *F04B 43/067* (2013.01); *F04B 43/073* (2013.01); *F04B 53/06* (2013.01); *F04B 53/10* (2013.01); *F04B 53/14* (2013.01); *F04B 53/16* (2013.01)

(58) Field of Classification Search
USPC ..... 417/395
See application file for complete search history.

(56) References Cited

U.S. PATENT DOCUMENTS

| | | | | |
|---|---|---|---|---|
| 3,680,981 | A | 8/1972 | Wagner | |
| 3,769,879 | A | 11/1973 | Lofquist, Jr. | |
| 3,775,030 | A | 11/1973 | Wanner | |
| 3,884,598 | A | 5/1975 | Wanner | |
| 3,953,154 | A | 4/1976 | Wanner | |
| 4,430,048 | A | 2/1984 | Fritsch | |
| 5,667,368 | A | 9/1997 | Augustyn et al. | |
| 5,707,219 | A * | 1/1998 | Powers | F04B 43/067 417/269 |
| 6,019,124 | A | 2/2000 | Sebion et al. | |
| 6,468,056 | B1 | 10/2002 | Murakoshi | |
| 6,582,206 | B2 | 6/2003 | Schluecker | |
| 6,899,530 | B2 | 5/2005 | Lehrke et al. | |
| 7,090,494 | B2 | 8/2006 | Lehrke et al. | |
| 7,425,120 | B2 | 9/2008 | Hembree | |
| 7,654,801 | B2 * | 2/2010 | Spude | F04B 43/0081 417/386 |
| 7,665,974 | B2 | 2/2010 | Hembree | |
| 2004/0086398 | A1 | 5/2004 | Lehrke et al. | |
| 2004/0228748 | A1 | 11/2004 | Lehrke et al. | |

OTHER PUBLICATIONS

International Search Report and Written Opinion for Application No. PCT/US2015/059027 dated Jan. 20, 2016.

* cited by examiner

DIAPHRAGM PUMP WITH DUAL SPRING OVERFILL LIMITER

BACKGROUND OF THE INVENTION

Field of the Invention

The present invention is related to a diaphragm pump and in particular to a hydraulically driven diaphragm pump with an overfill limit assembly utilizing two springs having different spring constants.

Description of the Prior Art

Diaphragm pumps are pumps in which the pump fluid is displaced by a diaphragm. In hydraulically driven pumps, the diaphragm is deflected by hydraulic fluid pressure forced against the diaphragm. Such pumps have proven to provide a superior combination of value, efficiency and reliability. However, such pumps require safeguards to prevent a hydraulic oil overfill condition. For synchronous high pressure pumps, such conditions may lead to the piston striking the manifold and cause pressure spikes against the diaphragm that could cause the diaphragm to fail.

To prevent such failures, systems have been developed to limit overfill. U.S. Pat. No. 6,899,530 to Lehrke and Hembree, and assigned to Wanner Engineering, Inc., of Minneapolis, Minn., teaches an improved valve system to limit overfill. The system uses a stiffer spring than conventional pumps and also has a vent groove in the cylinder that allows for priming the hydraulic chamber. However, such systems may leak small amounts of oil in the pressure stroke at very high pressures. Even such small leaks may not be acceptable for certain applications, thereby limiting the utility of such a system to low pressure pumps.

A further system also developed by Lehrke and Hembree and assigned to Wanner Engineering, Inc., is disclosed in U.S. Pat. No. 7,090,474. This patent discloses a system that eliminates the vent groove and uses a soft spring that applies force to the diaphragm even when empty. This configuration allows the pump to prime without a vent groove. However, to prevent overfilling, a travel limiter is utilized on the valve spool that causes an increase in pressure when the hydraulic chamber is overfilled. Therefore, under some conditions, the pressure may rise sharply when the diaphragm is overfilled and may lead to stress on the diaphragm in such conditions.

It can therefore be appreciated that a diaphragm pump with an overfill limiter is needed that avoids the problems of the prior art. Such a system should achieve a low pressure drop across the diaphragm that allows oil priming without requiring a vent groove in the cylinder and should also prevent excessive overfill, but also avoids excessive pressure levels as may occur with a rigid travel limiter. Moreover, such a pump and system should be inexpensive, easy to manufacture and service, and should minimize stresses to the diaphragm to maintain high reliability. The present invention addresses these as well as other problems associated with diaphragm pumps.

SUMMARY OF THE INVENTION

A diaphragm pump includes a housing having a pumping chamber for fluid to be pumped. A transfer chamber is adapted to contain hydraulic fluid deflecting the diaphragm and is in fluid communication with a fluid reservoir. A cylinder is contained in the pump housing and includes a piston sliding in a reciprocating motion and pumping hydraulic fluid. The piston also includes a piston inner chamber and a port forming a valve leading to the piston inner chamber to control hydraulic fluid flow. A valve spool slidably mounts in piston inner chamber to cover the valve in a first position and uncover the valve in a second position. A plunger connects the valve spool to the diaphragm. A first spring in the piston inner chamber is positioned intermediate the valve spool and the spacer and has a first spring constant. Movement of the first spring is limited by a spacer slidably mounted in the piston inner chamber. A second spring is also positioned in the piston inner chamber intermediate the end of the piston inner chamber and the spacer. The second spring has a second spring constant greater than the first spring constant. Therefore, the first spring compresses first and then the second spring compresses. In an overfill condition, the first and second springs act on the valve spool to cover the valve port and prevent additional overfilling.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
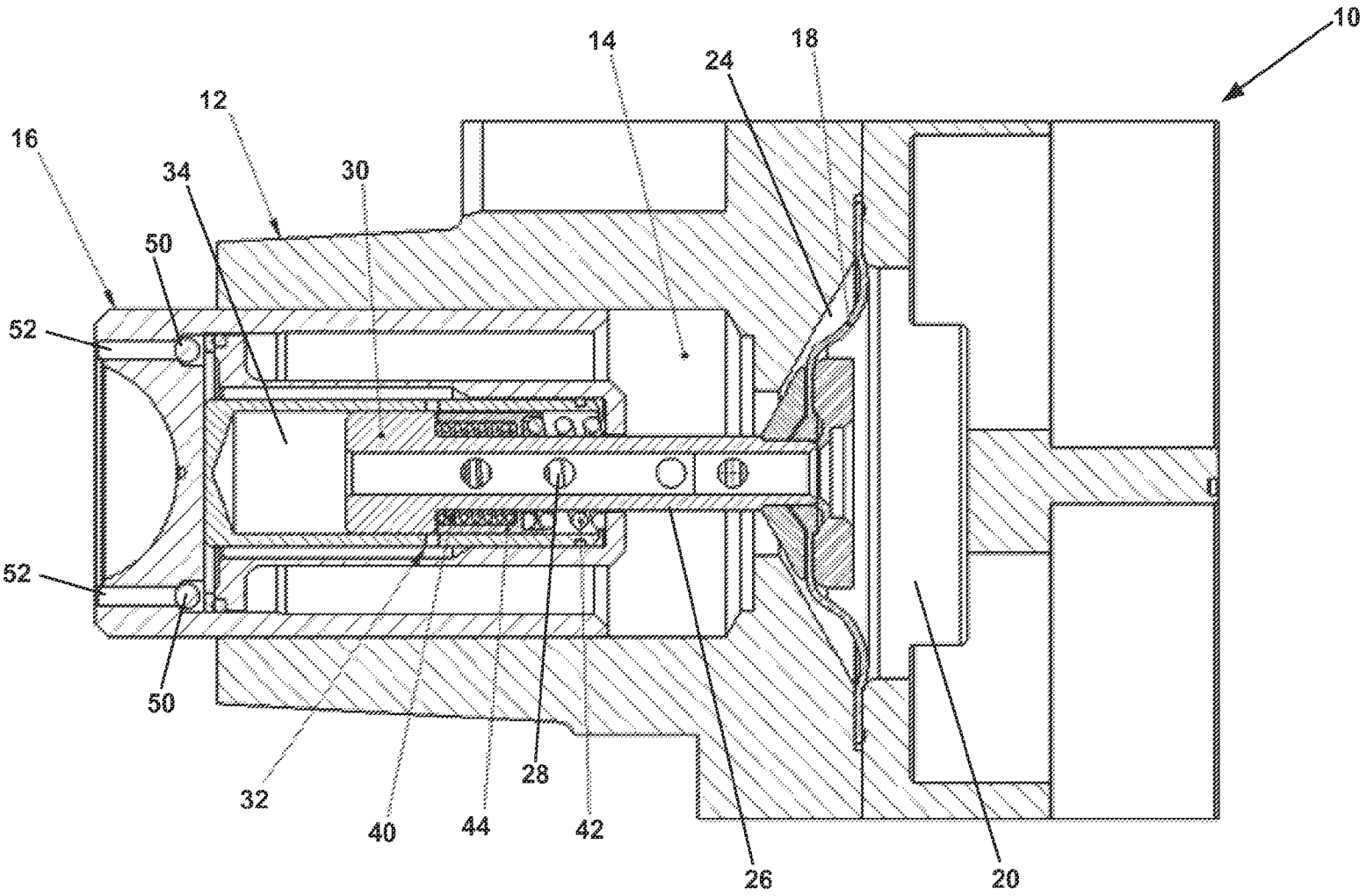
FIG. 1 is a side sectional view of a diaphragm pump according to the principles of the present invention in a first position.

Referring now to the drawings and in particular to FIGS. 1-4, there is shown a diaphragm pump, generally designated (10). The diaphragm pump (10) includes a pump housing (12). The housing (12) forms a cylinder (14) that receives a reciprocating piston (16). The diaphragm (18) forms a barrier between the transfer chamber in which oil acts on the diaphragm and a pumping chamber (20) receiving the fluid to be pumped. The diaphragm (18) deflects in a reciprocating manner to pump the fluid.

A plunger (26) extends from a valve spool (30) in the piston (18) and connects to the diaphragm (18). The plunger (26) may be hollow and have holes (28) formed therein that provides for oil flow when replenishment of oil in the transfer chamber is needed. The valve spool (30) moves longitudinally along the direction of travel of the piston (16) within a cavity (34) formed in the interior of the piston (16). A valve port (32) is formed in the side of the piston (16) and is covered by the valve spool (30) to open and close the passage of hydraulic oil under normal operating conditions. The end of the piston (16) includes inlets (52) and ball type check valves (50) that control flow of hydraulic fluid from a hydraulic oil reservoir. The valve spool (30) also includes a first spring (40), a second spring (42) that is stiffer than the first spring (40), and a movable spacer (44) that are configured to function as an overfill limiter.

Figure 3:
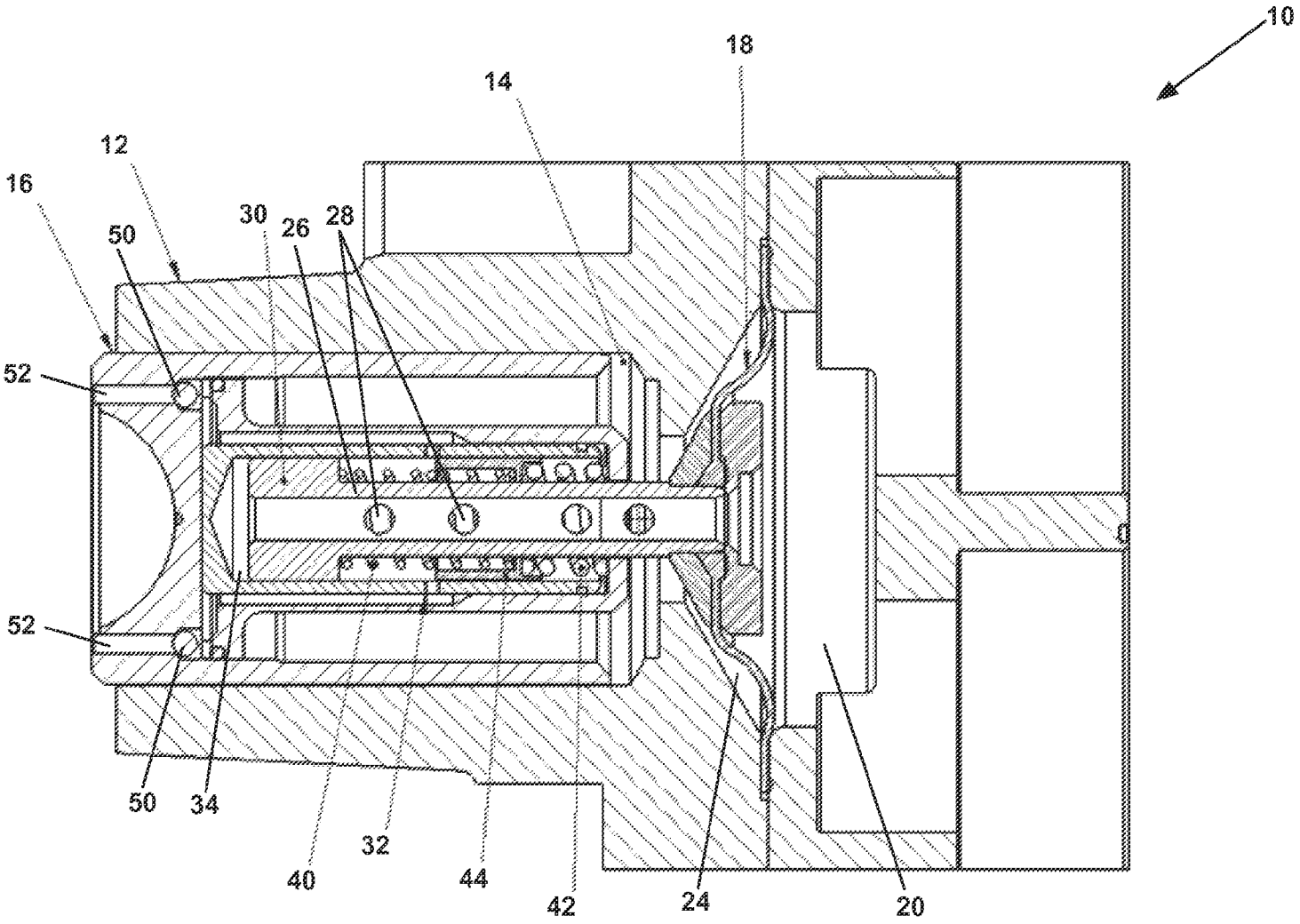
FIG. 3 is a side sectional view of a diaphragm pump shown in FIG. 1 in a third position.

Referring to FIG. 3, the pump (10) is shown configured at startup without having been primed with hydraulic oil. The piston (16) is at the top dead center position. However, with no hydraulic oil, the diaphragm (18) is forced to the bottom dead center position by the first spring (40). At this position, the valve spool (30) does not cover the valve port (32). The first spring (40) is compressed during installation with the deflection of approximately one inch so that at the startup position, the first spring (40) exerts a small pressure such as for example, 2 psi. The springs (40 and 42) have different spring constants, with the second spring (42) being stiffer and with a higher spring constant than the first spring (40). A typical spring constant for the first spring (40) will result in approximately 10 psi across the diaphragm (18) while the second spring (42) may have a spring constant that produces approximately 100 psi. It can be appreciated that when the first spring (40) is being acted on, deflection of 1.96 inches provides a pressure of 4 psi in the embodiment shown. From a dry startup as shown in FIG. 3, the springs (40 and 42) produce a pressure of between 1-4 psi to assist with priming the pump (10) with hydraulic oil. In the embodiment shown and in the startup configuration of FIG. 3, the first spring (40) is compressed during installation so that the startup pressure is approximately 2 psi.

Referring to FIG. 1, the pump (10) is shown with the piston (16) at the bottom dead center position. In this position, the diaphragm (18) is pulled back into the transfer chamber rather than being deflected outward. At this position, the valve spool (30) covers most of the valve port (32) but does not seal the valve port (32). This is a normal operating position when the pump (10) is primed and working as designed.

Figure 2:
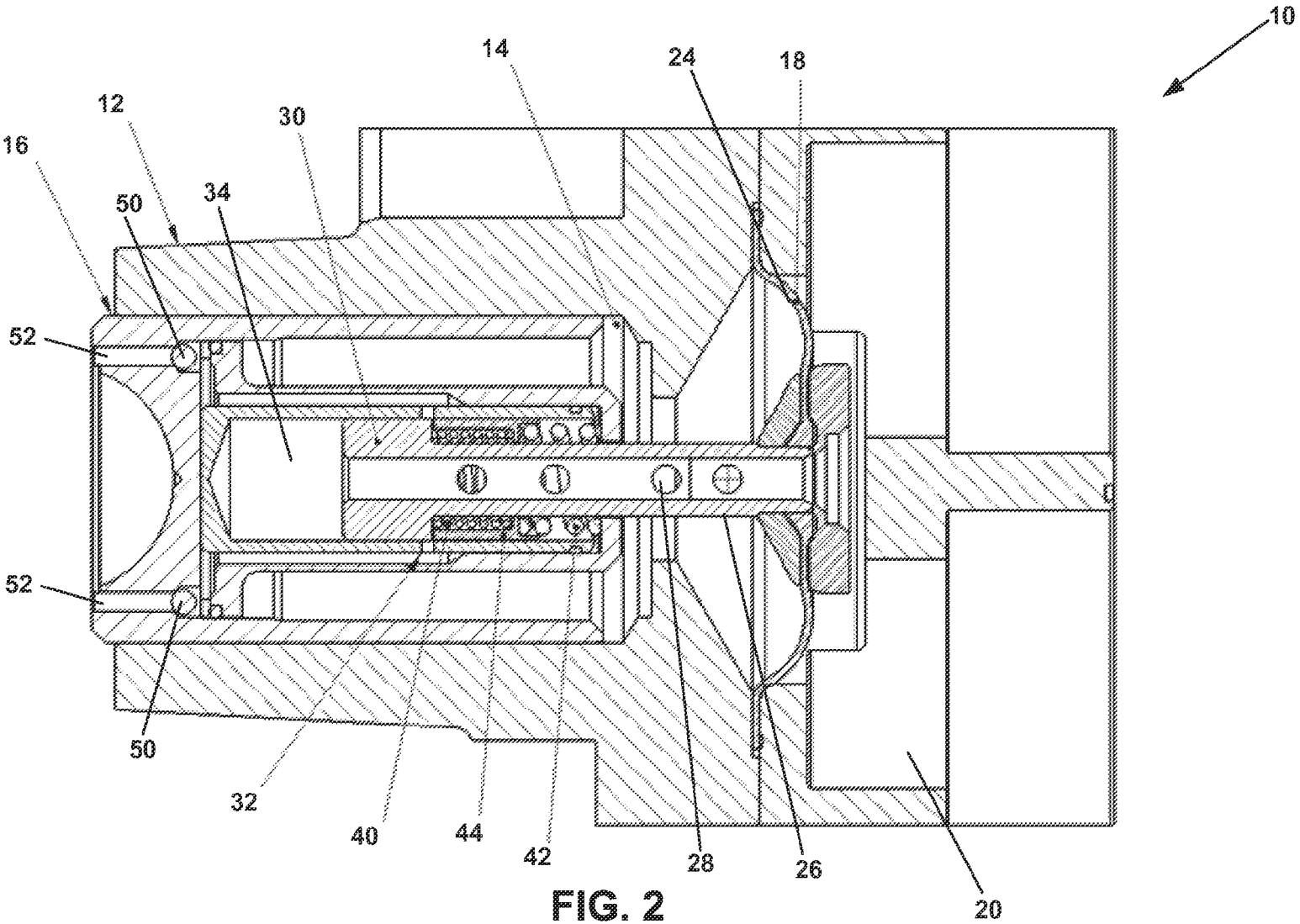
FIG. 2 is a side sectional view of a diaphragm pump shown in FIG. 1 in a second position.

Referring to FIG. 2, the piston (16) is at the top dead center position. The diaphragm (18) is deflected outward to act on fluid to be pumped. The valve spool (30) is positioned so that the port (32) is slightly open. This is a normal operating position when the pump (10) is primed and working as designed.

Figure 4:
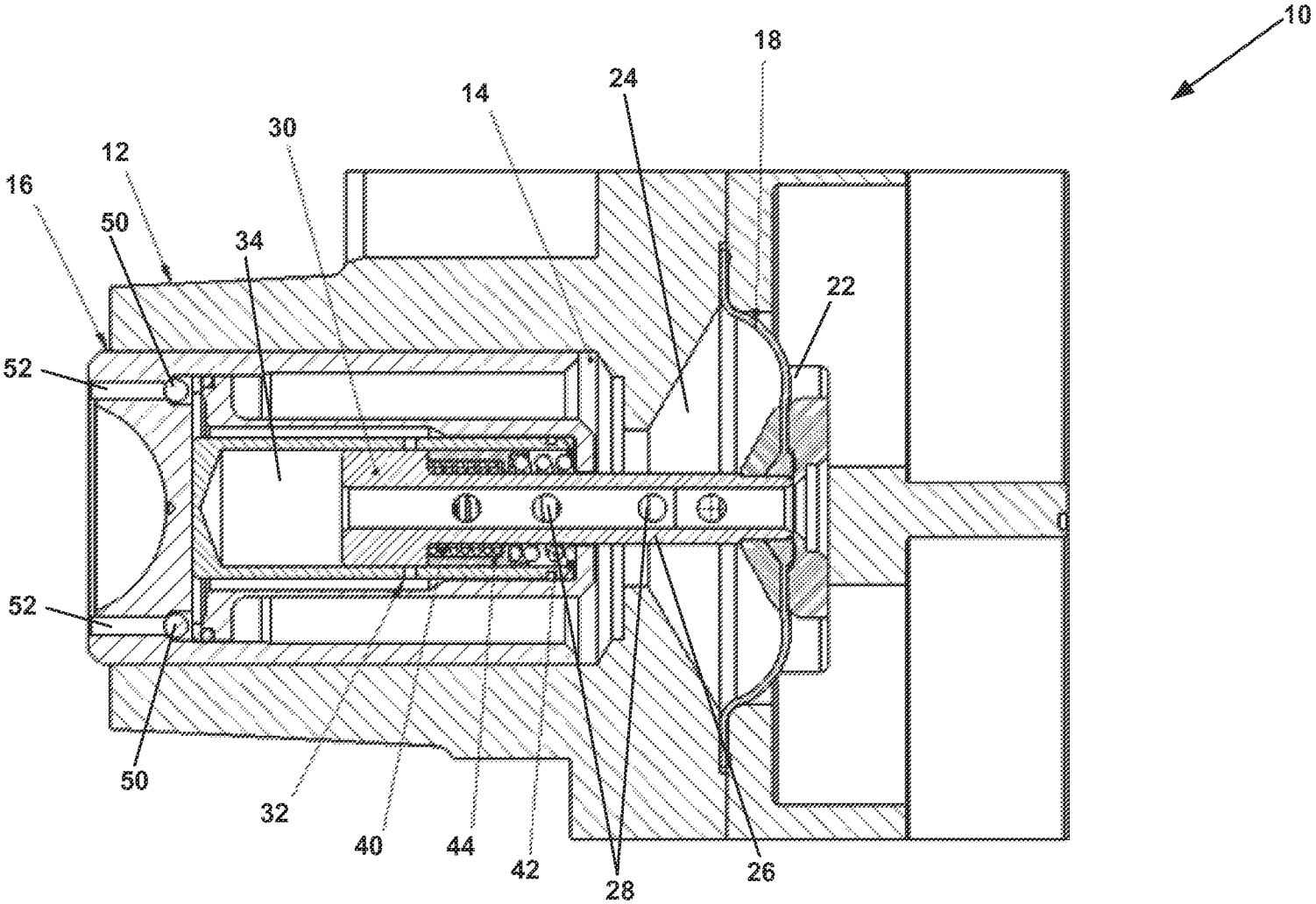
FIG. 4 is a side sectional view of a diaphragm pump shown in FIG. 1 in a fourth position.

In FIG. 4, the pump (10) is an overfill condition with the piston (16) at top dead center. In such a condition, the valve spool (30) is moved to contact the spacer (44) and completely compresses the first spring (40), which has a lower spring constant. As the first spring (40) cannot be further compressed, the load also compresses the second spring (42). The valve spool (30) is moved at this condition so that the valve port (32) is fully covered by the valve spool (30). It can be appreciated that with the higher spring constant of the second spring (42), normally only a very slight deflection of the second spring (42) is required in order to prevent further overfill. It can be appreciated that the first and second springs (40 and 42) are configured to limit overfill in a very simple configuration without requiring special channels, conduits or other modifications to the piston (16) and/or cylinder (14) as in previous systems. Moreover, the system of the present invention is reliable and relatively inexpensive to manufacture while providing automatic overfill limiting to safeguard against damage to the pump (10).

Figure 5:
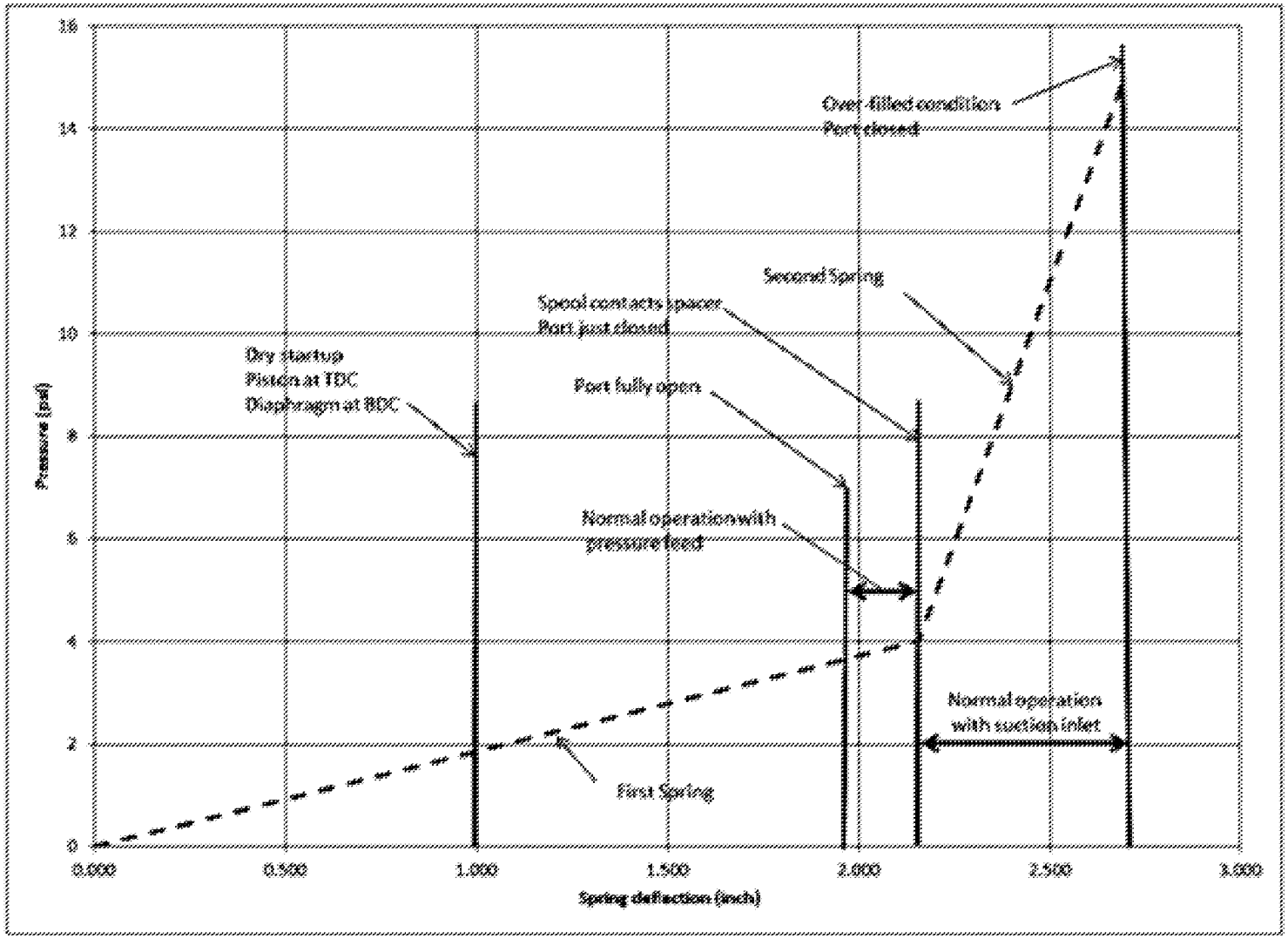
FIG. 5 is a graph of pressure versus spring deflection for the overfill assembly of the diaphragm pump shown in FIG. 1.

Referring now to FIG. 5, the pressure and its effect on the springs (40 and 42) can be appreciated. For the embodiment shown, the pump has a piston area of 4.9 square inches, which is an equivalent area of the diaphragm (18). Therefore, the force applied by the diaphragm divided by the equivalent area gives the pressure across the diaphragm (18) according to the formula P=F/A where P is the pressure, F is the force and A is the area. The first spring with a spring constant of 100 psi, when deflected one half inch over 4.9 square inches, would result in a pressure of approximately 10 psi. In normal operation, the springs (40 and 42) produce between 2-5 psi. It can be appreciated that additional pressure stresses the diaphragm (18) and could result in failure. Less pressure makes priming difficult and increases net positive suction head required ($NPSH_R$). Moreover, it can be seen that in the configuration shown, when the piston (16) is at the overfill position at top dead center and the diaphragm (18) is close to touching the manifold, the pressure is between approximately 10-15 psi. It is preferred to keep the pressure driving hydraulic oil to the chamber at below atmospheric pressure (approximately 14.7 psi at sea level) so that in practice the pump (10) usually produces less than 10 psi vacuum and up to 15 psi is normally acceptable.

It can be appreciated that the present invention provides a reliable diaphragm pump (10) with a simple and reliable overfill limiter. The overfill limiter is simple and reliable and functions automatically. Moreover, the pump (10) requires only simple modifications for the overfill limiting system.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A diaphragm pump comprising:

a housing having a pumping chamber containing fluid to be pumped;

a transfer chamber adapted to contain hydraulic fluid, and a hydraulic fluid reservoir in fluid communication with the transfer chamber;

a cylinder;

a piston sliding in a reciprocating motion in the cylinder, the piston defining a piston inner chamber, the piston inner chamber having an end;

a valve leading to the piston inner chamber;

a valve spool slidably mounted in the piston inner chamber, the valve spool covering the valve in a first position and uncovering the valve in a second position;

a moveable spacer slidably mounted in the piston inner chamber intermediate the valve spool and the end of the piston inner chamber;

a diaphragm connected to the valve spool by a plunger and supported by the housing, the diaphragm defining a pumping chamber side and a transfer chamber side, the pumping chamber side at least partially defining the pumping chamber and the transfer chamber side at least partially defining the transfer chamber;

a first spring in the piston inner chamber engaging the valve spool and a first side of the moveable spacer, the first spring having a first spring constant;

a second spring in the piston chamber engaging the end of the piston inner chamber and a second side of the moveable spacer, the second spring having a second spring constant greater than the first spring constant.

2. A diaphragm pump according to claim 1, wherein the valve comprises a port in the piston.

3. A diaphragm pump according to claim 1, wherein the first spring is configured so that at dry startup the springs exert pressure of 1 to 4 psi.

4. A diaphragm pump according to claim 1, wherein the plunger comprises a hollow shaft forming a fluid communication path from the reservoir to the transfer chamber.

5. A diaphragm pump according to claim 1, wherein the second spring is configured to exert a pressure less than atmospheric pressure.

6. A diaphragm pump according to claim 1, wherein the diaphragm pump comprises a synchronous pump.

7. A diaphragm pump according to claim 1, further comprising a motor providing power to actuate the piston.

8. A diaphragm pump according to claim 1, wherein the first spring and the second spring are configured so that at dry startup the springs exert pressure of 1 to 4 psi;

wherein in normal operation position the springs exert pressure of 2 to 5 psi; and wherein in an over-filled condition, the springs are configured to exert a pressure of 10 to 15 psi.

9. A diaphragm pump comprising:

a housing having a pumping chamber containing fluid to be pumped;

a transfer chamber adapted to contain hydraulic fluid, and a hydraulic fluid reservoir in fluid communication with the transfer chamber;

a cylinder;

a piston sliding in a reciprocating motion the cylinder, the piston defining a piston inner chamber, the piston inner chamber having an end;

a valve leading to the piston inner chamber;

a valve spool slidably mounted in the piston inner chamber, the valve spool covering the valve in a first position and uncovering the valve in a second position;

a moveable spacer slidably mounted in the piston inner chamber intermediate the valve spool and the end of the piston inner chamber;

a diaphragm connected to the valve spool by a plunger and supported by the housing, the diaphragm defining a pumping chamber side and a transfer chamber side, the pumping chamber side at least partially defining the pumping chamber and the transfer chamber side at least partially defining the transfer chamber;

a first spring in the piston inner chamber engaging the valve spool and a first side of the moveable spacer, the first spring having a first spring constant;

a second spring in the piston chamber engaging the end of the piston inner chamber and a second side of the moveable spacer, the second spring having a second spring constant greater than the first spring constant;

wherein the first spring and the second spring are configured so that at dry startup the springs exert pressure of 1 to 4 psi;

wherein in normal operation position the springs exert pressure of 2 to 5 psi; and wherein in an over-filled condition, when the piston is at top dead center, the springs are configured to exert a pressure of 10 to 15 psi.

* * * * *